United States Patent [19]

Oberheim et al.

[11] 4,185,531

[45] Jan. 29, 1980

[54] MUSIC SYNTHESIZER PROGRAMMER

[75] Inventors: Thomas E. Oberheim, Santa Monica; James L. Cooper, Los Angeles, both of Calif.

[73] Assignee: Oberheim Electronics, Inc., Santa Monica, Calif.

[21] Appl. No.: 809,614

[22] Filed: Jun. 24, 1977

[51] Int. Cl.[2] ..... G10H 3/00

[52] U.S. Cl. ..... 84/1.11; 84/1.19; 84/1.24; 84/1.28

[58] Field of Search ..... 84/1.01, 1.03, 1.17, 84/1.24, 1.28, 1.11, 1.19, DIG. 9

[56] References Cited

U.S. PATENT DOCUMENTS

| | | | |
|---|---|---|---|
| 3,172,939 | 3/1965 | Campbell, Jr. et al. | 84/1.01 X |
| 3,213,179 | 10/1965 | Clauson | 84/1.03 |
| 3,422,718 | 1/1969 | Noehren | 84/1.03 |
| 3,646,241 | 2/1972 | Ott | 84/1.17 X |
| 3,821,712 | 6/1974 | Wetzel | 84/1.01 |
| 3,833,750 | 9/1974 | Iorio | 84/1.17 X |
| 3,890,871 | 6/1975 | Oberheim | 84/1.01 |
| 3,935,781 | 2/1976 | Katoh et al. | 84/1.19 X |
| 3,948,139 | 4/1976 | Melcher et al. | 84/1.19 |
| 3,981,218 | 9/1976 | Luce | 84/1.24 |
| 3,992,969 | 11/1976 | Robinson et al. | 84/1.01 |
| 4,073,209 | 2/1978 | Whittington et al. | 84/1.01 X |
| 4,078,465 | 3/1978 | Wheelwright | 84/1.01 |

*Primary Examiner*—Ulysses Weldon

*Attorney, Agent, or Firm*—Freilich, Hornbaker, Wasserman, Rosen & Fernandez

[57] ABSTRACT

A programmer for a music synthesizer including a keyboard and M independent voice modules (channels) and wherein the characteristics of each module are dependent upon K independent parameters, each parameter defined by an analog voltage level. The programmer is capable of storing N distinct programs, each program including information defining K parameters for each of M modules. The programmer is comprised of a common set of K potentiometers which are coupled through an analog to digital (A/D) converter means. The output of the A/D converter means is applied selectively either to a digital memory for storage at a location defined by operator controlled switches or through a digital to analog (D/A) converter means to the voice modules. Alternatively, information applied to the D/A converter means for application to the voice modules can be derived from the digital memory.

7 Claims, 5 Drawing Figures

MUSIC SYNTHESIZER PROGRAMMER

FIELD OF THE INVENTION

This invention relates to electronic musical instruments, and more particularly to improvements in electronic synthesizers.

BACKGROUND OF THE INVENTION

An electronic music synthesizer is a keyboard instrument capable of producing sounds with selected characteristics regarding such parameters as pitch (frequency), envelope (slope of attack and decay), and timbre (overtone structure). Although early synthesizers were monophonic in that they were capable of producing only one note at a time, polyphonic synthesizers have recently been developed such as is disclosed in U.S. Pat. No. 3,986,423.

As has been recognized in U.S. Pat. No. 3,981,218, synthesizers in the past have included a variety of programmable or adjustable functions, the variation of which results in changes in the quality of sound produced by the instrument. A difficulty is presented during the playing of such an instrument, however, when the player wishes to rapidly change from one sound quality to a different sound quality. In the past, the only way that such a shift could be made, if it involved changing more than a very few function parameters, was by the operator adjusting a series of manual controls until the parameters were changed as desired. This is in most cases a relatively time-consuming task and requires the attention of the player to each of the function controls, successively, so that it is not ordinarily possible for the player to continue to play the instrument while he is changing the configuration of the controls. Thus, the instrument can be configured to produce radically different sounds, involving the adjustment of several function controls, only at the beginning of a musical performance. Drastic and sudden changes in sound during the playing of a musical composition are not ordinarily possible, because of the need to manipulate the controls one-by-one.

In view of the foregoing, said U.S. Pat. No. 3,981,218 teaches a system for storing function presets for an electronic music synthesizer whereby any of a plurality of preselected functional configurations can be selected by operation of a single switch, rather than by manual adjustment of a plurality of manual controls. Although the system disclosed in said U.S. Pat. No. 3,981,218 certainly facilitates a player's ability to easily modify the synthesizer characteristics, it is limited in versatility being restricted to a finite number of stored groups of function presets.

Moreover, whereas said U.S. Pat. No. 3,981,218 addresses the player's problem associated with attempting to reconfigure a monophonic instrument, the problem is of course considerably compounded in a polyphonic instrument.

An exemplary polyphonic synthesizer comprises a unit marketed by Oberheim Electronics, Inc., Santa Monica, Calif., which includes multiple independent voice modules or channels. Each module includes two voltage-controlled oscillators (VCO's), a voltage-controlled filter (VCF), a voltage-controlled amplifier (VCA) and two envelope generators. Multiplexer logic, as is disclosed in said U.S. Pat. No. 3,986,423, responds to a common keyboard to assign and distribute the independent keyboard control voltages (CV's) to the multiple voice modules. The multiplexer continually searches the keyboard at high speed to detect when a note has been played, and directs control voltages to a voice module as determined by keyboard logic, and the settings of keyboard switches.

SUMMARY OF THE INVENTION

The present invention is directed to an improved programmer apparatus useful in both monophonic and polyphonic electronic synthesizers for enabling multiple parameter settings to be easily established and repeated.

More particularly, the present invention is directed to a programmer for an electronic synthesizer which enables multiple sets of K parameters to be digitally stored and selectively accessed. Briefly, the programmer is comprised of: means for digitally storing a plurality (N) of parameter groups, each group including K parameters for each of a plurality (M) of voice modules; selection control means for selecting any one group of parameters; and means responsive to the selection control means for applying the parameters in the selected group to the respective modules.

In a preferred embodiment of the invention, a single set of K potentiometers is provided. A multiplexer successively couples the K potentiometer output signals to an A/D converter. In a manual mode of operation, the A/D converter output is coupled to a D/A converter. In a memory write mode, the A/D converter output is stored in a digital memory at one of N locations defined by a program select switch means. A module select switch means defines the location of one of M fields into which information is written. In a memory read mode, information is read from the location defined by the program select switch means and applied to the D/A converter. A demultiplexing means routes the output of the D/A converter to K·M sample/hold circuits.

The novel features that are considered characteristic of this invention are set forth with particularity in the appended claims. The invention will best be understood from the following description when read in conjunction with the accompanying drawings.

DESCRIPTION OF A PREFERRED EMBODIMENT

Figure 1:
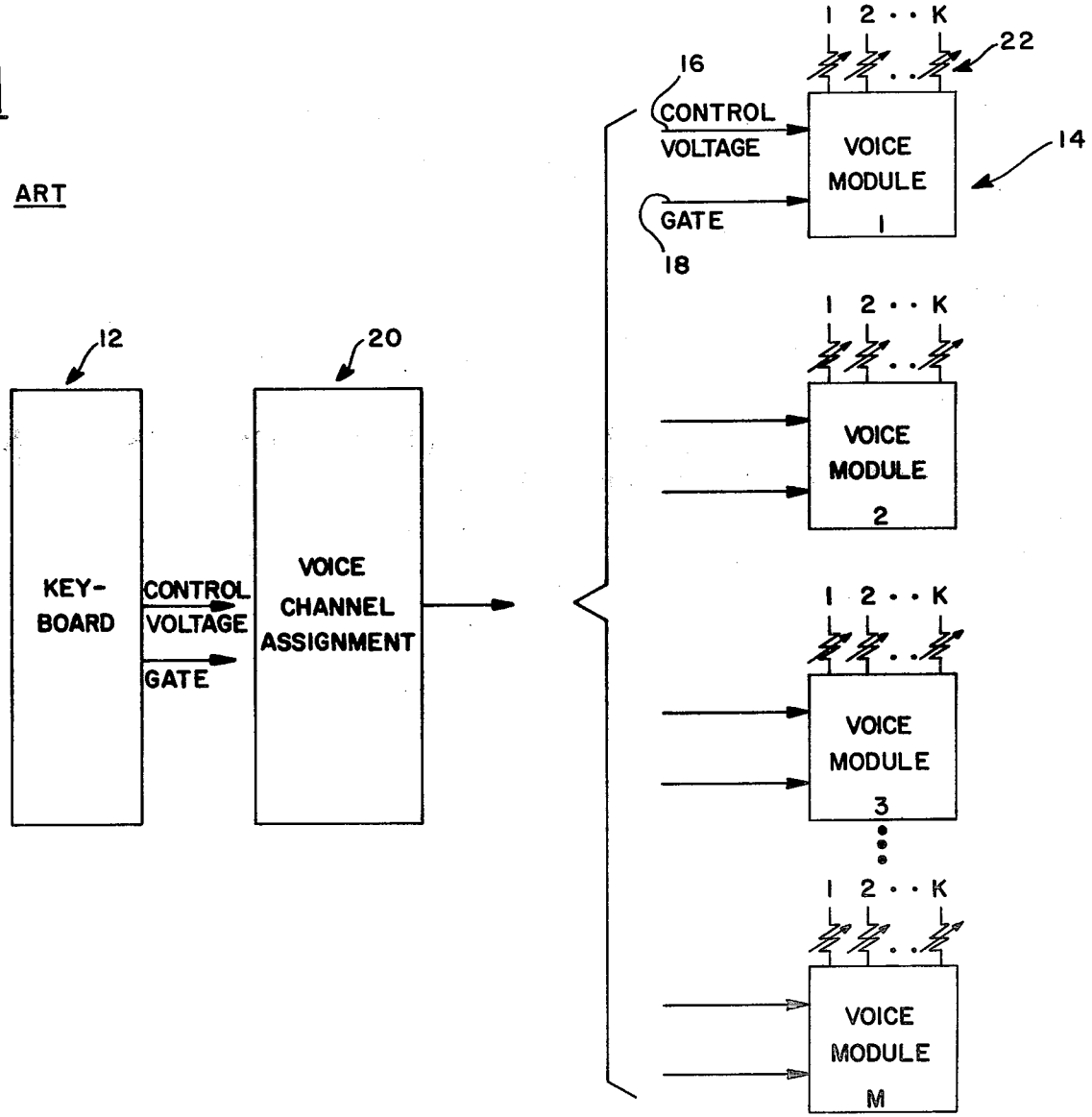
FIG. 1 PRIOR ART
FIG. 1 is a block diagram illustrating an electronic polyphonic music synthesizer of the type shown in U.S. Pat. No. 3,986,423.

Attention is now called to FIG. 1 which illustrates a block diagram of a polyphonic music synthesizer of the type disclosed in U.S. Pat. No. 3,986,423. The synthesizer is essentially comprised of a keyboard 12 including a plurality of individually actuatable keys and a plurality of M independent voice modules or channels 14. Although the programmer in accordance with the present invention can be utilized in synthesizers employing essentially any number of keys or voice modules, the exemplary embodiment of the invention disclosed herein will be assumed to utilize a 64-key keyboard and four (M) voice modules or channels.

The keyboard 12 comprises a standard keyboard of the type employed in conventional music synthesizers and accordingly will not be described herein in detail. It essentially consists of 64 individually actuatable single pole single throw switches biased to be normally open. When a key is depressed by the performer, the key will close and remain closed only so long as the performer continues to depress the key.

The plurality of voice modules 14 are preferably similar to one another and each consists of a plurality of voltage-controlled elements (not shown) such as an oscillator (VCO), an amplifier (VCA), a filter (VCF), and other elements. The voice modules will not be described in detail herein because each individual voice module can be identical to that typically found in conventional synthesizers. Each voice module is responsive to the application of a control voltage applied to its input terminal 16 and a gate signal applied to its input terminal 18 to produce a sound having a certain pitch and a certain duration. Typically, the synthesizer or voice module will produce a sound whose pitch is related to the direct current level of the control voltage supplied thereto. Thus, typically if a one-volt control voltage is applied to a voice module, it will produce a sound of a certain pitch and if the control voltage level is then increased to two volts, the pitch will be correspondingly increased by one octave, i.e., the frequency will be doubled.

The gate signal supplied to each voice module determines the duration of the sound produced. That is, the sound will be initiated when the gate signal first appears and will be terminated in response to the termination of the gate signal. The control voltage and gate signal are produced by the keyboard in response to the depression of a key. The control voltage and gate signal are assigned to a particular voice module 14 by voice channel assignment logic 20 which is disclosed in detail in the aforementioned U.S. Pat. No. 3,986,423.

In a typical music synthesizer, a plurality of independent manually-controllable potentiometers 22 are provided to define various parameter values which establish the characteristics of the voice module. Thus, as is shown in FIG. 1, K potentiometers 22 are provided for supplying analog voltages to the voice module which control the voltage-controlled elements within the module. For example only, one of the K parameter voltages could be applied to the voltage-controlled filter (not shown) within the voice module to establish its cutoff frequency characteristics. Another parameter voltage could be applied to an envelope generator (not shown) within the voice module to define the decay characteristic of the envelope. Thus, by adjusting the K parameter voltages applied to a voice module, the module can be made to produce a desired characteristic sound responsive to the depression of a key in keyboard 12 by the performer.

Although modern music synthesizers are very versatile and enable an accomplished performer to create an enormous variety of sounds, the multiplicity of controls typically associated with modern synthesizers make them difficult for many performers to utilize in a live performance. For example, a typical four-voice synthesizer of the type depicted in FIG. 1 may have close to 100 separate control knobs and switches for the performer to manipulate. This creates problems for those who wish to use the synthesizer in a live performance or in a studio where studio time may cost $100 per hour. In order to overcome this obstacle to utilization of a synthesizer in these circumstances, the present invention is directed to a programmer which easily enables the performer to switch from one "patch" to another virtually instantaneously. The term "patch" is used to refer to any particular set of control knob and switch settings associated with the M voice channels. For simplicity, it will be assumed that in order to create a particular patch for the examplary synthesizer described herein, it is necessary to set the positions of M·K control knobs where M represents the number of voice channels and K represents the number of controllable parameters per voice channel. It will further be assumed that in the preferred embodiment $M=4$ and $K=12$.

Figure 2:
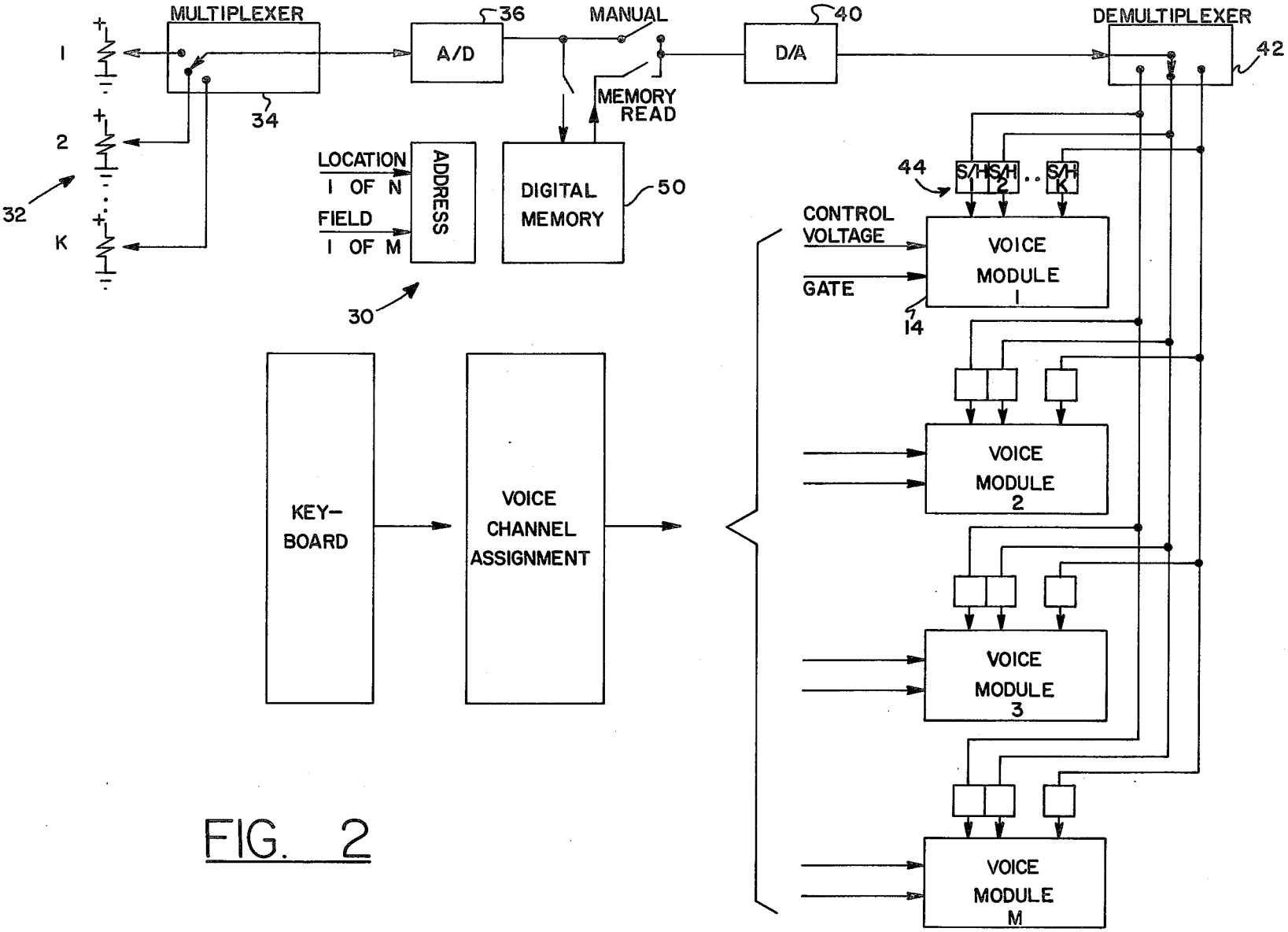
FIG. 2 is a block diagram of an electronic polyphonic music synthesizer showing a programmer, in accordance with the present invention, incorporated therein.

Attention is now directed to FIG. 2 which illustrates the synthesizer of FIG. 1 modified to incorporate a programmer 30 in accordance with the present invention. Briefly, the programmer 30 in accordance with the preferred embodiment of the invention is comprised of a single set of K potentiometers 32. More particularly, the K potentiometers 32 are sequentially sampled by a multiplexer 34 which successively supplies the sampled voltage levels to an analog-to-digital converter 36. The output of the converter 36 can be coupled directly through a manual mode switch 38 to the input of a digital-to-analog converter 40. The output of the converter 40 is coupled through a demultiplexer 42 to analog storage or sample and hold circuits 44 coupled to the parameter voltage inputs of the M voice modules.

More particularly, whereas in the prior art synthesizer of FIG. 1, K potentiometers were illustrated as being connected to each of the M voice modules, FIG. 2 illustrates that in lieu of those potentiometers, K sample and hold circuits 44 are connected to the input of each voice module. The sample and hold circuits 44 are loaded from the demultiplexer 42 in a manner to be described in greater detail hereinafter in connection with FIG. 3.

Whereas it has been mentioned that the output of the A/D converter 36 can be coupled directly through the manual mode switch 38 to the input of the D/A converter 40, in accordance with a significant aspect of the present invention, the output of converter 36 can alternatively be coupled to a digital memory 50. More particularly, a memory write mode switch 52 is illustrated in FIG. 2 as coupling the output of the converter 36 to the data input port of digital memory 50. The data output port of the digital memory 50 is coupled through a memory read mode switch 54 to the input of the D/A converter 40.

It is contemplated that the memory 50 be capable of storing N different patches or programs. In order to define each complete patch, each program location in the memory 50 must be capable of storing M·K parameters. Thus, each program location N in the digital memory 50 includes M fields, each field including K subfields.

Figure 3:
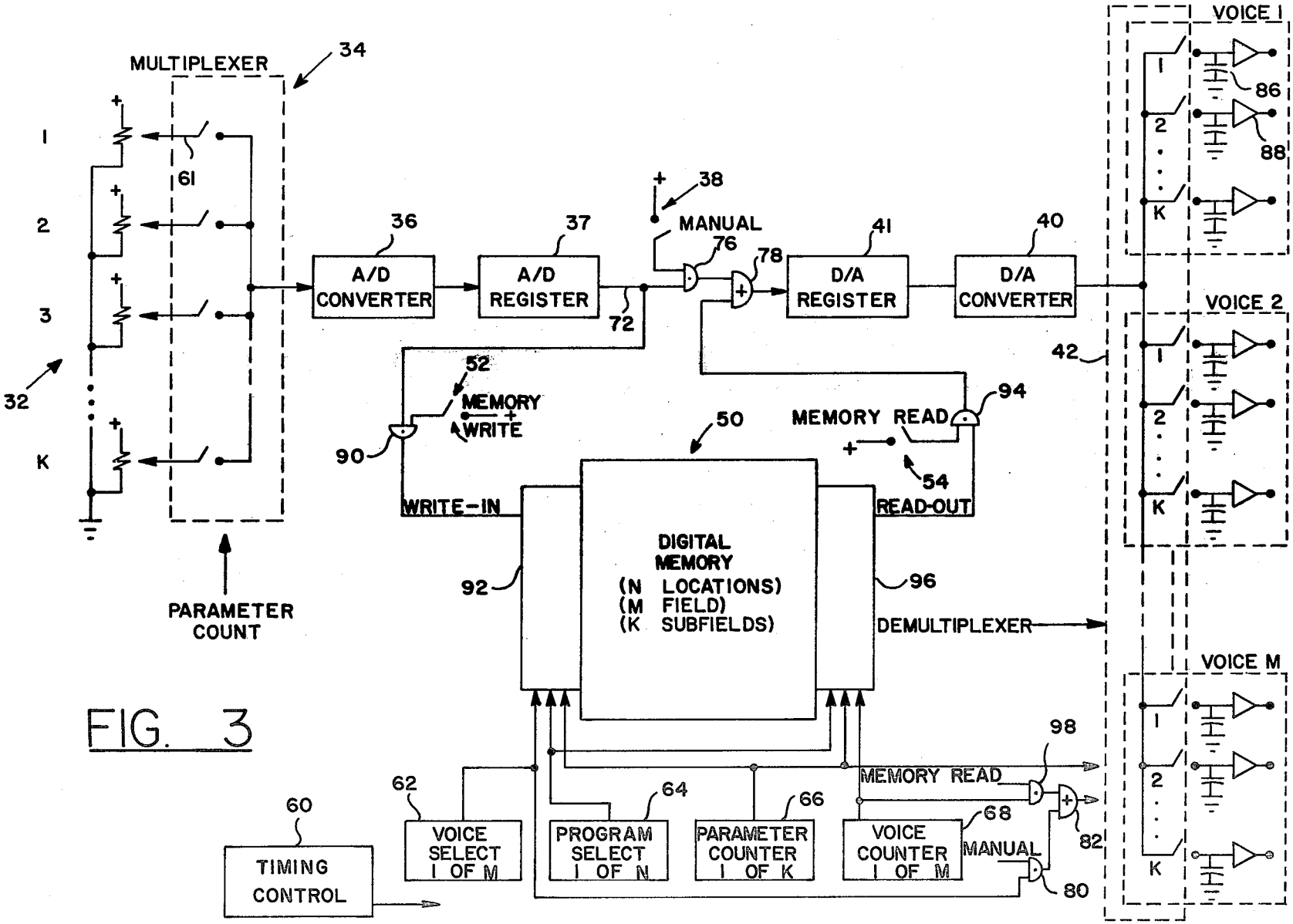
FIG. 3 is a block diagram of a preferred embodiment of the present invention.

Attention is now directed to FIG. 3 which illustrates the programmer 30 in greater detail than has been represented in FIG. 2.

The programmer of FIG. 3 includes timing control means 60 which generates the necessary timing signals (partially shown in FIG. 4) to effect the necessary switch closures and data transfers required in the operation of the programmer of FIG. 3. In considering the programmer of FIG. 3, reference will initially be made to the manual controls available to the performer. Initially, K potentiometers 32, previously referred to in FIG. 2, are provided. Each of these potentiometers has a suitable control knob (not shown) enabling the performer to adjust the voltage supplied to the potentiometer slider output 61.

Additionally, the performer has access to and control of mode switches including a manual mode switch 38, a memory write mode switch 52, and a memory read mode switch 54. Still further, the performer has access to and control of switches enabling him to identify a particular one of M voice channels. This voice select switch bank is identified at 62. Further, a switch bank 64 enables the performer to identify and select one of N programs.

In addition to the aforementioned manual controls available to the performer, the programmer of FIG. 3 includes a parameter counter 66 capable of defining K distinct digital states. The parameter counter is controlled by the timing control means 60. Still further, the programmer of FIG. 3 includes a voice counter 68 capable of defining M distinct digital states. The counter 68 is also driven by the timing control means 60. The relationship between the counter 66 and 68 is that for each state of voice counter 68, the parameter counter 66 will define K states. Both counters 66 and 68 comprise cyclic counters.

The digital memory 50 can be implemented using any of the available technologies such as magnetic core or semiconductor. For convenience in explanation, it will be assumed to contain N locations, each comprising a recirculating shift register. Each of the N shift registers will be assumed to include M fields, with each of the M fields being comprised of K sub-fields. Each sub-field can indeed be comprised of as many bits as are necessary to define the necessary number of parameter voltage levels. For example, if it is desired that the performer be able to define a parameter voltage level with a resolution of one in thirty-two, then it will be necessary for that sub-field to be comprised of five bits.

The bank of K independent potentiometers 32 is connected through a multiplexer 34. The multiplexer 34 is controlled by the parameter counter 66 so that the K potentiometer outputs are sequentially coupled to the input of the A/D converter 36 in synchronism with the stepping of the parameter counter 66. The A/D converter 36, for each state of the parameter counter 66, supplies a digital representation of the analog voltage supplied thereto at its output to the input of an A/D storage register 37. The contents of the register 37 are available on its output line 72 for selective application either to the D/A register 41 or the digital memory 50, dependent upon the position of the performer-controlled mode switches 38 and 52. Assume initially that mode switch 38 is closed and mode switch 52 is open. As a consequence, the contents of digital register 37 will be coupled through And gate 76 and Or gate 78 to the input of digital register 41. The output of register 41 is applied to the D/A converter 40 which supplies an analog voltage to the data input of demultiplexer 42. The demultiplexer 42 is illustrated as being comprised of K·M switches 79 which steer the output of converter 40 to the particular bank of sample and hold circuits selected by the voice select means 62 and to the particular sample and hold circuit selected by the parameter counter 66. That is, in the manual mode defined when switch 38 is closed, the output of the voice select means 62 will be coupled through And gate 80 and Or gate 82 to the demultiplexer 42. Additionally, the output of parameter counter 66 will sequentially apply the analog signal generated by converter 40 to the K sample and hold circuits of the selected bank of sample and hold circuits. For simplicity, each sample and hold circuit has been illustrated as being comprised merely of a capacitor 86 and an amplifier 88. Thus, in use of the programmer in the manual mode, the performer will initially identify one of the voice channels utilizing the voice select switch bank 62. He will then adjust his K potentiometers 32 and the voltage levels established thereby will be supplied to the sample and hold circuit bank connected to the selected voice channel.

After the performer arrives at a satisfactory setting of his K potentiometers 32, he can store digital representations of these settings by opening the manual mode switch 38 and closing the memory write switch 52. Closure of the memory write switch 52 enables And gate 90. Thus, the digital contents of register 37 will be steered through And gate 90 and written into the memory 50 via the address gating means 92 into a location identified by the contents of the program select means 64. The digital representations of the K parameters will be stored within the field identified by the voice select means 62 in synchronism with the stepping of the parameter counter 66.

In the use of the synthesizer in a performance, for example, the performer can read out a program or patch from the memory 50 and apply it to the sample and hold circuit banks of the voice modules. To do this, the performer opens the memory write switch 52 and manual mode switch 38 and closes the memory read switch 54 to enable And gate 94. The data input from And gate 94 is taken from the memory read out port via address gating means 96. The output of gate 94 is applied to the input of Or gate 78. In the memory read mode, the contents of the location identified by the program select means 64 is read out in synchronism with the stepping of the voice counter 68 and parameter counter 66. The information read out of the memory 50 through the gate 94 is converted from digital to analog form by converter 40 and applied to the data input terminal of the demultiplexer 42. The demultiplexer 42 steers the analog signal supplied by converter 40 to the M sample and hold circuit banks in accordance with the stepping of voice counter 68 applied to the demultiplexer via And gate 98 and Or gate 82. The output of parameter counter 66 sequentially couples the output of converter 40 to the K sample and hold circuits of each circuit bank.

Figure 4:
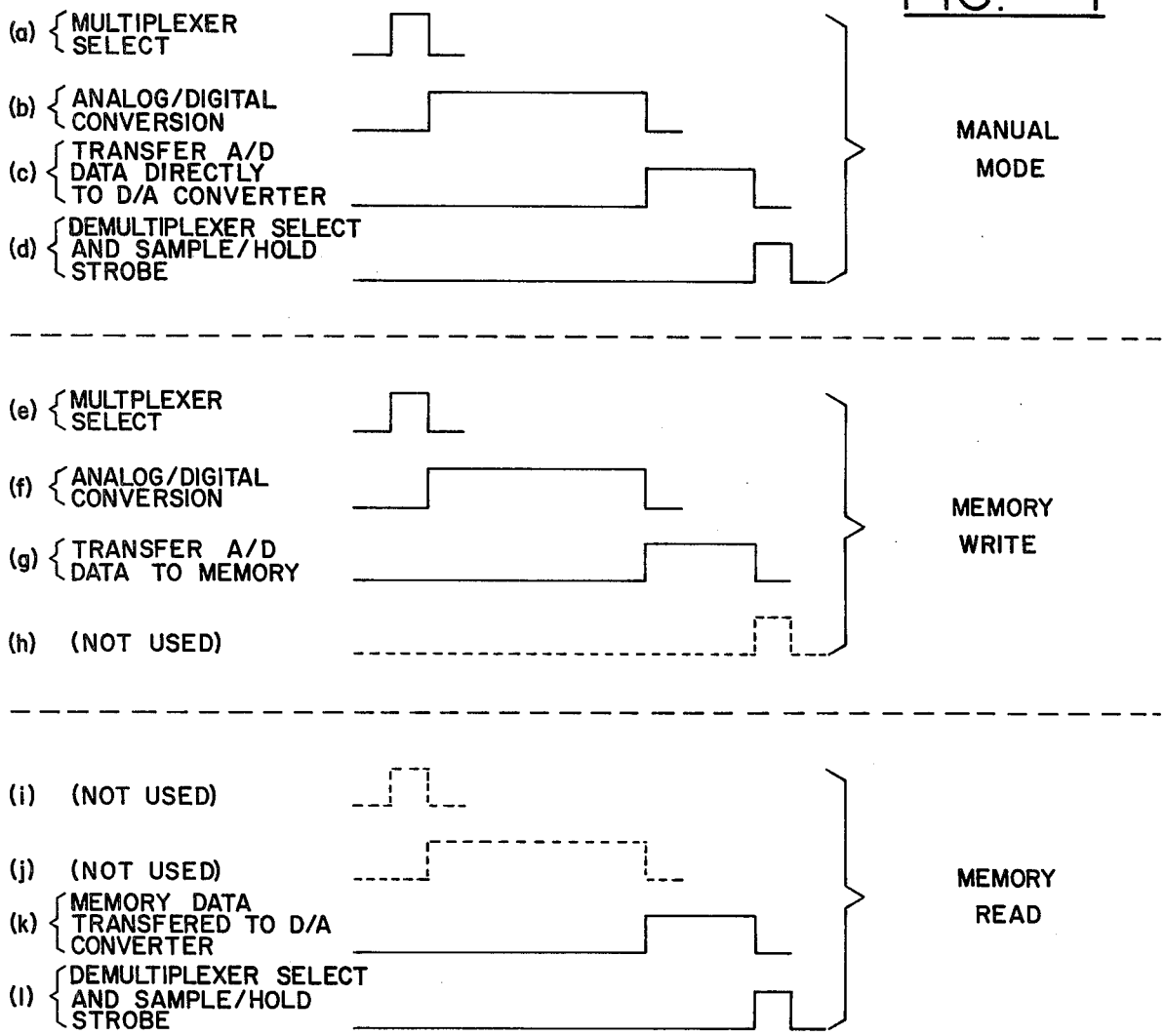
FIGS. 4 and 5 are timing diagrams illustrating the time relationships between operations performed during the processing of a single parameter and operations with respect to multiple operations.
Figure 5:
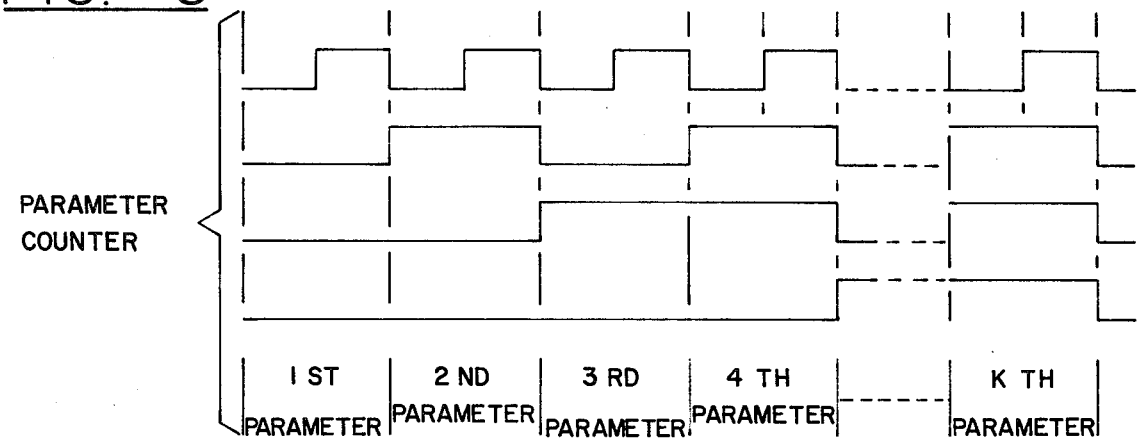

FIG. 4 illustrates the timing signals developed by the timing control means 60 in connection with the processing of a single one of the K parameters. Lines (a)–(d) define the manual mode of operation. Line (a) represents a switch closure in multiplexer 34 as defined by the count in parameter counter 68. Line (b) shows that thereafter the analog-to-digital conversion process takes place with converter 36. Line (c) represents the transfer of digital data from converter 36 and the digital-to-analog conversion process performed by converter 40. Line (d) represents the demultiplexing operation comprised of steering the output of converter 40 to the selected one of K sample and hold circuits.

Lines (e)–(h) of FIG. 4 illustrate the timing for the memory write operation. Lines (i)–(l) depict the timing for the memory read operation.

From the foregoing, it should now be appreciated that a programming apparatus has been disclosed herein for utilization in a music synthesizer for enabling a user to establish the parameter settings for the synthesizer, to store those settings, and to retrieve those settings as needed. Thus, utilization of the programming apparatus in accordance with the invention, enables N different programs or patches to be stored for essentially instantaneous recall by the performer. It should be appreciated that although particular values of K, M and N have been assumed herein to facilitate an explanation of the invention, the teachings of the invention are applicable to a synthesizer having any values of K, M and N. Similarly, although a preferred implementation has been disclosed, it is recognized that equivalent variations will readily be apparent. For example only, multiple position switches could be readily substituted for potentiometers 32, NAND-NOR gates could be substituted for the AND-OR gates disclosed, etc.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In combination with an electronic music synthesizer including a keyboard for generating control voltages and at least one voice module responsive to said control voltages for producing musical tones whose characteristics are dependent upon multiple independent parameter voltages, a programmer means for supplying said parameter voltages to said voice module, said programmer means comprising:

a plurality of manually controllable analog signal sources, each capable of independently producing a variable level analog signal:

first converter means responsive to an applied analog input signal for producing a representative digital output signal;

multiplexing means for sequentially coupling said plurality of analog signal sources to said first converter means;

digital memory means including a plurality of program locations;

manually controllable addressing means for enabling a user to selectively identify any selected one of said program locations;

means for storing said digital signals produced by said first converter means in the program location of said digital memory means identified by said addressing means;

second converter means responsive to applied digital input signals for producing representative analog output signals;

means for reading digital signals from the program location of said digital memory means identified by said addressing means and applying them to said second converter means; and means applying said analog signals produced by said second converter means to said voice module.

2. The combination of claim 1 wherein said means applying said analog signals includes a plurality of analog storage circuits associated with said voice module, each for storing an analog signal corresponding to that produced by one of said analog signal sources.

3. The combination of claim 2 including demultiplexing means responsive to said analog output signals produced by said second converter means for sequentially loading said plurality of analog storage circuits.

4. The combination of claim 1 wherein said plurality of manually controllable analog signal sources includes individual potentiometers.

5. The combination of claim 1 wherein said synthesizer includes multiple voice modules;

manually controllable voice module addressing means for identifying one of said multiple voice modules; and further including means responsive to said voice module addressing means for storing said digital signals in said identified program location in a field thereof identified by said voice module addressing means.

6. A programmer suitable for use with an electronic music synthesizer enabling K parameter settings to be manually set and selectively stored and retrieved, said programmer comprising:

a plurality of manually controllable potentiometers for respectively producing K different voltage signals;

an analog to digital converter means for producing a digital output representative of an applied analog input;

multiplexing means for sequentially coupling said plurality of potentiometers to said analog to digital converter means;

means for selectively defining either a manual operation mode or a memory operation mode;

a digital to analog converter means for producing an analog output representative of an applied digital input;

a plurality of analog storage circuits, each for storing the value of a different one of said K voltage signals;

demultiplexing means for sequentially coupling said digital to analog converter means analog output to said plurality of analog storage circuits;

digital memory means including a plurality of storage locations and a write-in port and a read-out port;

means responsive to the definition of said manual operation mode for coupling said analog to digital converter means digital output to said digital to analog converter means digital input; and means responsive to the definition of said memory operation mode for coupling said analog to digital converter means digital output to said memory write-in port and said memory read-out port to said digital to analog converter means digital input.

7. The programmer of claim 6 further including:

manually controllable program addressing means for identifying one of said storage locations; and manually controllable voice channel addressing means for identifying a particular field of the identified location; and means responsive to said program and voice channel addressing means for storing information coupled to said write-in port at the identified location and field and for applying information to said read-out port from said identified location and field.

* * * * *